US006773137B2

(12) United States Patent
Chang

(10) Patent No.: US 6,773,137 B2
(45) Date of Patent: Aug. 10, 2004

(54) TRAVELING CONTAINER WITH SAFETY ALERT SYSTEM

(76) Inventor: John Nia You Chang, 869 Country Rd., Monterey Park, CA (US) 91755

( * ) Notice: Subject to any disclaimer, the term of this patent is extended or adjusted under 35 U.S.C. 154(b) by 0 days.

(21) Appl. No.: 10/338,969

(22) Filed: Jan. 10, 2003

(65) Prior Publication Data

US 2004/0136183 A1 Jul. 15, 2004

(51) Int. Cl.[7] ..... A45C 15/06

(52) U.S. Cl. ..... 362/156; 362/217; 362/253; 362/311

(58) Field of Search ..... 362/156, 154, 362/155, 109–111, 253, 311, 183, 191, 217, 72, 205, 202

(56) References Cited

U.S. PATENT DOCUMENTS 4,172,274 A * 10/1979 Zemke ..... 362/111
5,123,467 A * 6/1992 Steinberg ..... 150/106
5,245,517 A * 9/1993 Fenton ..... 362/156
5,309,145 A * 5/1994 Branch et al. ..... 340/540
5,597,230 A * 1/1997 Newman ..... 362/154
6,179,440 B1 * 1/2001 Palmer ..... 362/249

* cited by examiner

*Primary Examiner*—Alan Cariaso
*Assistant Examiner*—Mark Tsidulko
(74) *Attorney, Agent, or Firm*—Raymond Y. Chan; David and Raymond Patent Group

(57) ABSTRACT

A traveling container includes a container body having an outer side, and a safety alert system including a power source supported by the container body and an illuminator provided on the outer side of the container body for providing an alerting signal and enhancing a visibility of the container body, thereby aiding to increase safety.

3 Claims, 7 Drawing Sheets

TRAVELING CONTAINER WITH SAFETY ALERT SYSTEM

BACKGROUND OF THE PRESENT INVENTION

1. Field of Invention

The present invention relates to a traveling container, and more particularly to a traveling container with a safety alert system which comprises an illuminator attached to a container body of the traveling container for providing an illuminating alert signal, thereby aiding to increase safety.

2. Description of Related Arts

Carrying containers are considered as one of the useful tools for traveling. A convention container such as a fabric type carrying baggage or a metal type carrying case has several drawbacks. One of the problem with the conventional carrying container is that they are bulky, usually heavy, and difficult to carry. Therefore, the carrying container is immobilized at all times. In other words, the user usually picks up the carrying container when he or she has to move from place to place.

For example, when the user waits for the check in at the airport, he or she will usually put the carrying container aside until the departure time comes, so that the carrying container will be stolen easily. In other words, there is no alert system incorporated with the conventional carrying container to prevent the carrying container from being unintentionally stolen.

In addition, all the conventional carrying containers are looked similar, the user may merely pick up a wrong carrying container that is not belong to him or her. Therefore, there are thousands of carrying containers lost at the airport everyday while the carrying containers are either taken by fault or stolen.

SUMMARY OF THE PRESENT INVENTION

A main object of the present invention is to provide a traveling container with a safety alert system which comprises an illuminator attached to a container body of the traveling container for providing an illuminating alert signal, thereby aiding to increase safety.

Another object of the present invention is to provide a traveling container with the safety alert system, wherein the safety alert system can be installed into any part of the traveling container such as a piping tube, a logo batch, a handle bar, or even a zipper head without altering the original structural design of the traveling container so as to minimize the manufacturing cost of the traveling container incorporating with the safety alert system.

Another object of the present invention is to provide a traveling container with the safety alert system, wherein the safety alert system additionally provides added visibility to the traveling container, so as to aid the user in notifying the traveling container in attendance.

Another object of the present invention is to provide a traveling container with the safety alert system, wherein no expensive or complicated structure is required to employ in the present invention in order to achieve the above mentioned objects. Therefore, the present invention successfully provides an economic and efficient solution for not only providing a safety alert configuration to the user but also enhancing the appearance and visibility of the traveling container.

Accordingly, in order to accomplish the above objects, the present invention provides a traveling container, comprising:

a container body having an outer side; and a safety alert system comprising a power source supported by the container body and an illuminator provided on the outer side of the container body for providing an alerting signal and enhancing a visibility of the container body.

DETAILED DESCRIPTION OF THE PREFERRED EMBODIMENT

Figure 1:
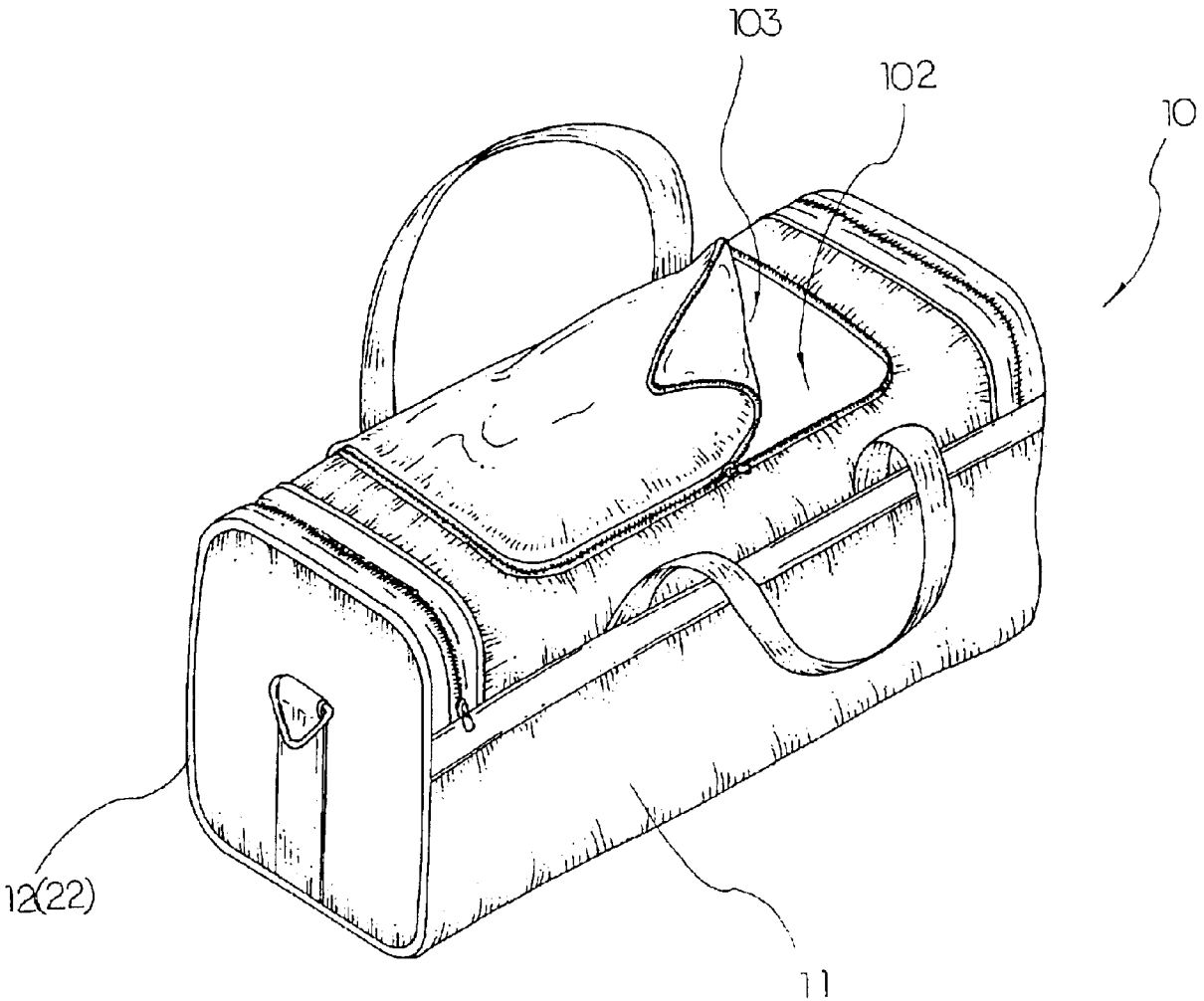
FIG. 1 is a perspective view of a traveling container incorporated with a safety alert system according to a first preferred embodiment of the present invention.
Figure 2:
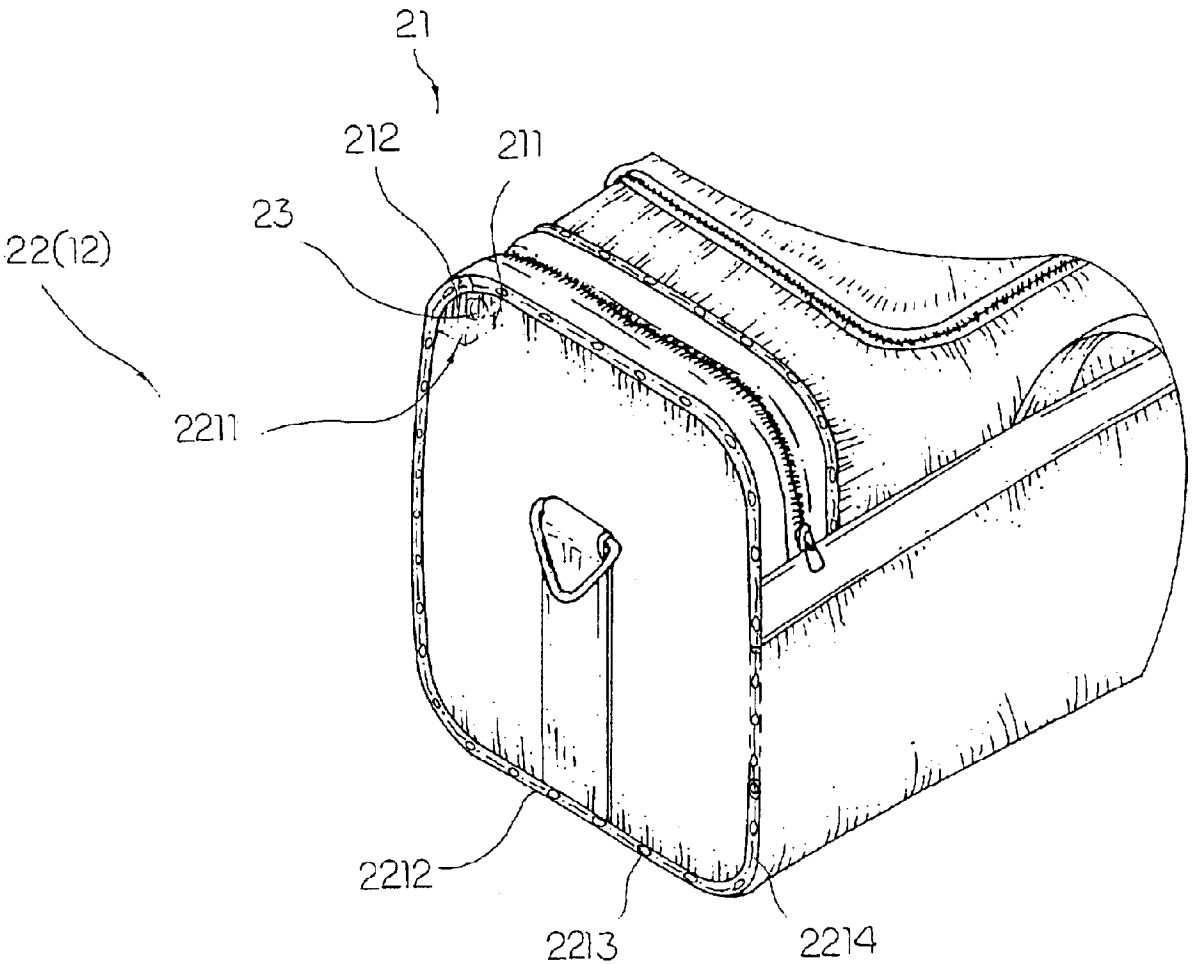
FIG. 2 is a perspective view of the safety alert system of the traveling container according to the above first preferred embodiment of the present invention.

Referring to FIGS. 1 and 2 of the drawings, a traveling container according to a first preferred embodiment of the present invention is illustrated, wherein the traveling container comprises a container body 10 having an outer side 101, and a safety alert system 20 comprising a power source 21 supported by the container body 10 and an illuminator 22 provided on the outer side 101 of the container body 10 for providing an alerting signal and enhancing a visibility of the container body 10.

According to the preferred embodiment, the container body 10, such as a conventional container body, comprises a plurality of fabric made container panels 11 and a plurality of piping tubes 12 affixedly extended along connection edges of the container panels 11 respectively to securely connect the container panels 11 in an edge to edge manner, wherein the piping tubes 12 are formed on the outer side of the container body 10. Accordingly, the container body 10 further has a storage cavity 102 defining within the container panels 11 and an opening 103 formed on one of the container panels 11 for communicating the storage cavity 102 with outside.

It is worth to mention that the piping tube 12 is one of the most common constructions of the container body 10 since the piping tube 12 is constructed as a reinforcing rim of the container body 10 for not only retaining the shape thereof but also provide a secure connection between the container panels 11.

As shown in FIGS. 1 and 2, the illuminator 22 comprises an elongated rope light 221 constructed as the piping tube 12 extended along the connection edge of the respective container panels 11, wherein the rope light 221 has a terminal end 2211 electrically connected to the power source 21 and comprises a tubular shelter 2212, having flexible ability, affixed along the connection edge of the respective container panels, at least an illuminating element 2213 disposed in the tubular shelter 2212, and a conductive element 2214 electrically connected the illuminating element 2213 to the terminal end 2211 of the rope light 221 in such a manner that the illuminating element 2213 is capable of generating light as the alerting signal to enhance the visibility of the container body 10.

Accordingly, the illuminating element 2213 is a LED securely disposed in the tubular shelter 2212 and the conductive element 2214 is a conductive wire electrically extended from the LED of the illuminating element 2213 towards the terminal end 2211 of the rope light 221. In other words, the illuminating element 2213 and the conductive element 2214 are protected by the tubular shelter 2212 so as to prevent any collision of the rope light 221 which may damage the illuminating element 2213.

Figure 3:
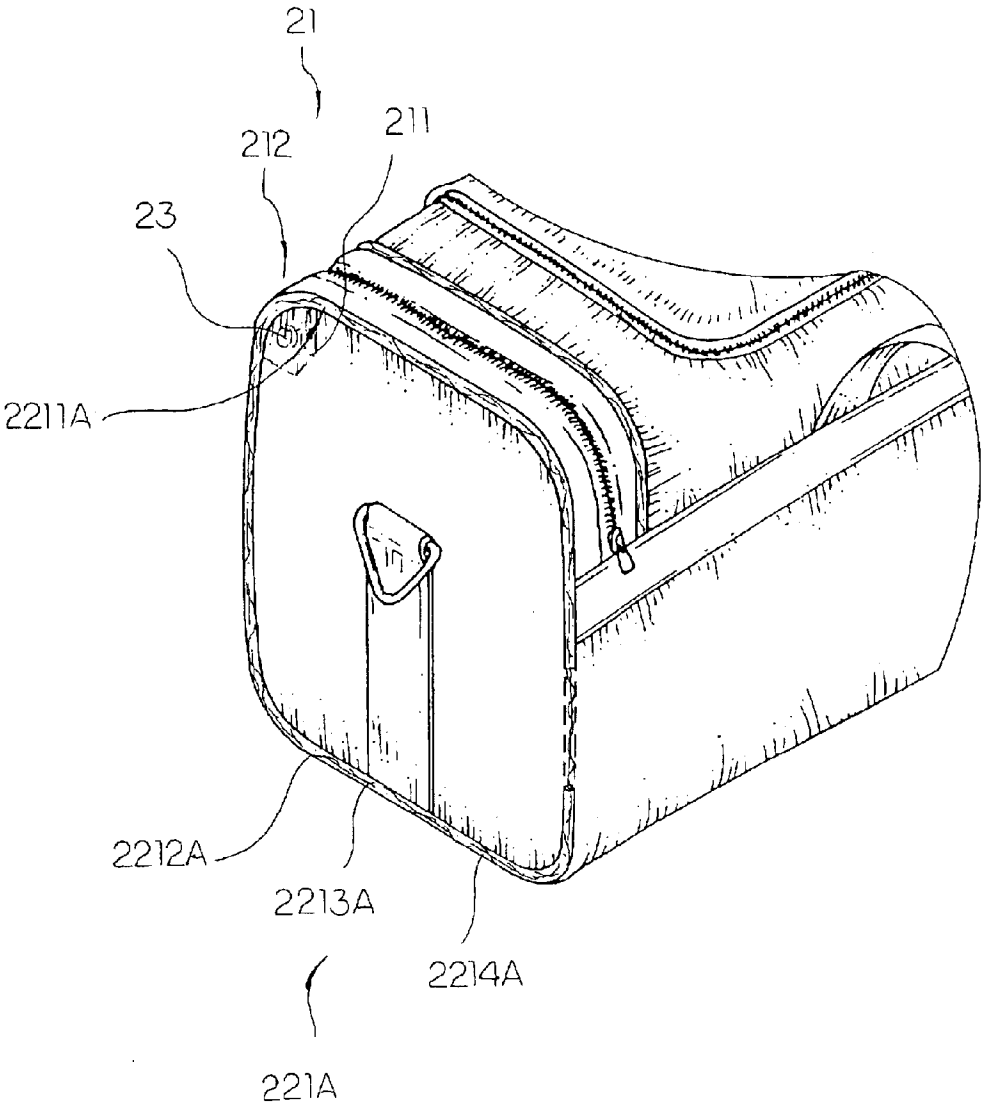
FIG. 3 illustrates an alternative mode of the rope light of the illuminator of the safety alert system according to the above first preferred embodiment of the present invention.

FIG. 3 illustrates an alternative mode of the rope light 221A which has a terminal end 2211A and comprises a tubular shelter 2212A having a flexible ability, at least an illuminating element 2213A disposed in the tubular shelter 2212A, and a conductive element 2214A electrically connected the illuminating element 2213A to the terminal end 2211A of the rope light 221A. The illuminating element 2213A is an elongated filament extended along the tubular shelter 2212A end to end and the conductive element 2214A is a conductive wire electrically extended from the filament of the illuminating element 2213A towards the terminal end 2212A of the rope light 221A.

The power source 21 comprises a battery housing 211 supported within the storage cavity 102 for receiving a replaceable battery and an electric socket 212 provided at the battery housing 211 to electrically connect with the terminal end 2211 of the rope light for electrically connecting with the replaceable battery.

The safety alert system 20 further comprises means 23 for switching the illuminator 22 in an on and off manner. The switching means 23 comprises a motion sensor 231 electrically connected to the power source 21 and arranged in such a manner that when the motion sensor 231 detects a movement of the container body 10, the illuminator 22 is automatically switched on to generate the alerting signal within a predetermined time period. In other words, the safety alert system provides the alerting signal when the container body 10 is moved by someone. Therefore, the alerting signal from the safety alter system will notify the user when the traveling container is unintentionally or intentionally taken by someone, thereby aiding to increase safety.

The switching means 23 can be a light sensor electrically connected to the power source 21 and arranged to automatically switch on the illuminator 22 in a low light condition to enhance the visibility of the container body 10.

Likewise, the switching means 23 can be a manual switch electrically connected to the power source 21 such that the user is able to selectively switch on and off the illuminator 22 manually to provide the alerting signal.

Figure 4A:
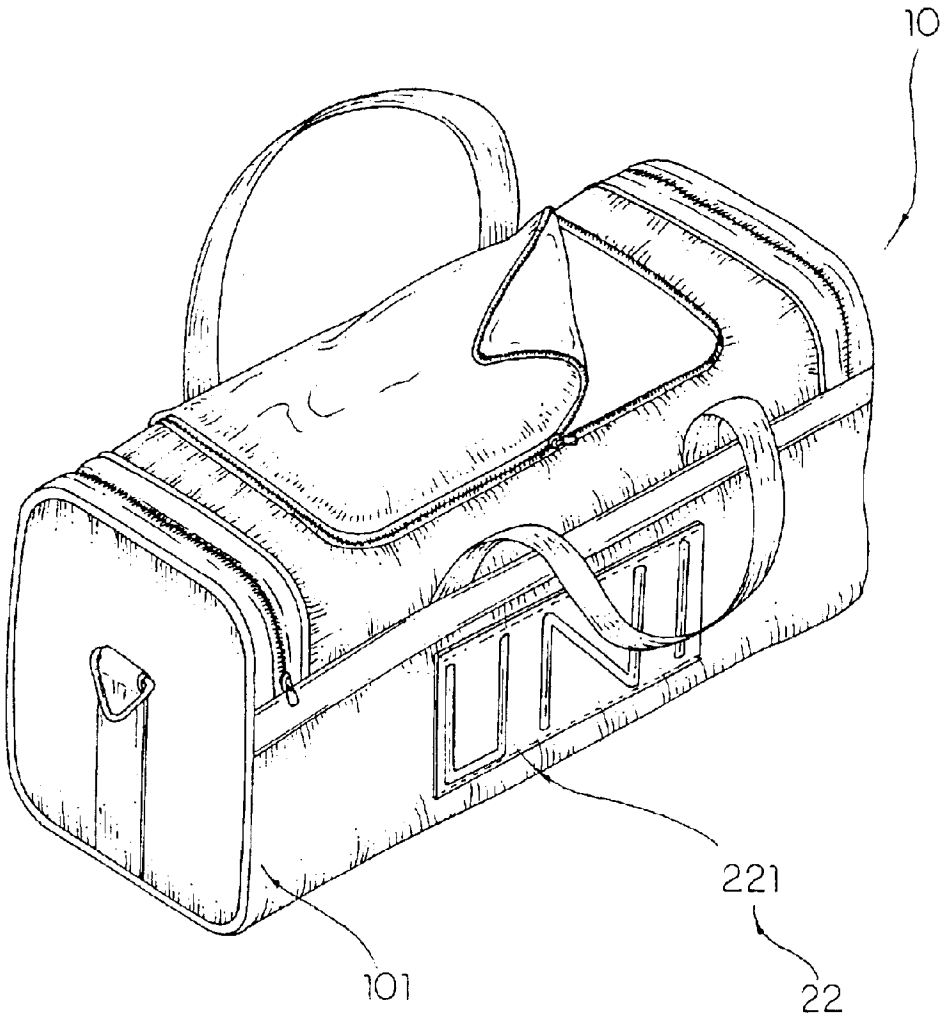
FIGS. 4A and 4B illustrate the safety alert system incorporated with different components of the traveling container according to the above first preferred embodiment of the present invention.

As shown in FIG. 4A, the rope light 221 of the illuminator 22 is shaped to form at least an illuminating character of a logo batch mounted on the outer side 101 of the container body 10 wherein the illuminating character is shaped as alphabet, A to Z, and number, 0 to 9. Therefore, the safety alert system not only provides the alerting signal for the container body 10 but also enhance the visibility of the logo batch thereon.

Figure 4B:
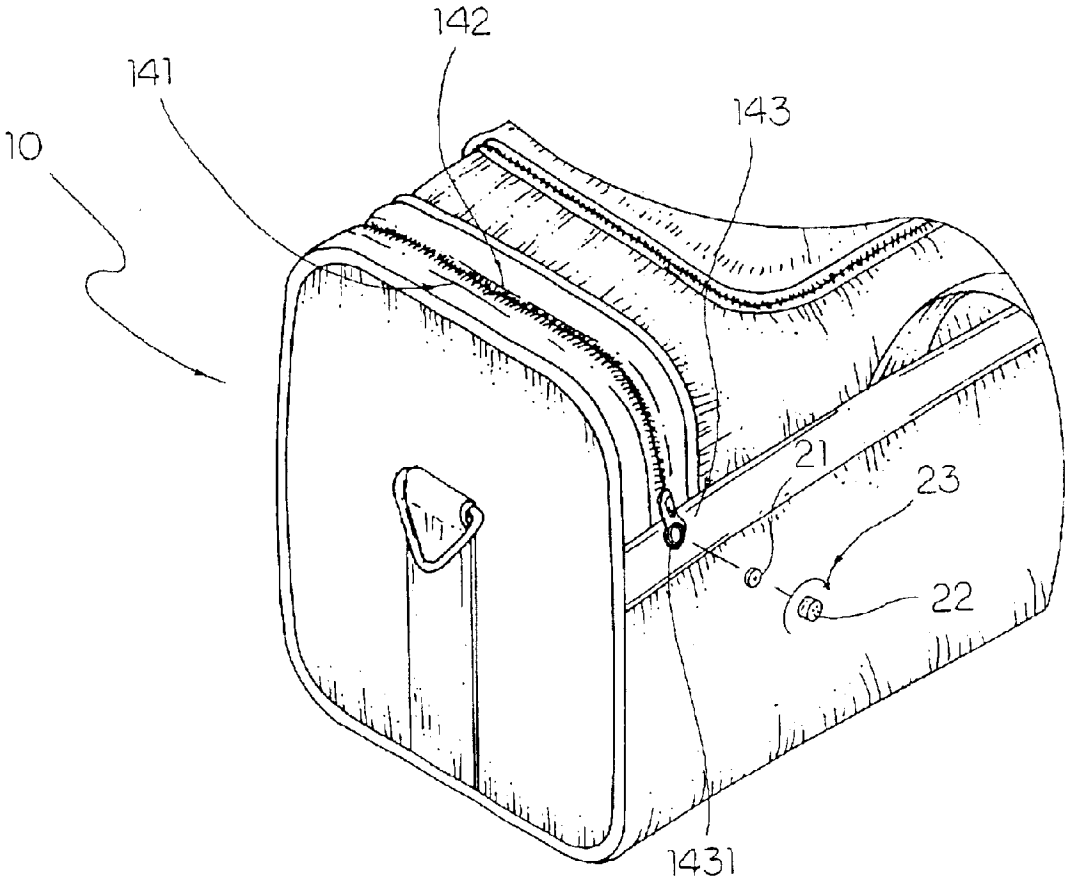

FIG. 4B illustrates that the safety alert system 20 is incorporated with another component of the container body 10. The container body 10 further comprises first and second zipping elements 141, 142 extended along two opposed edges of the opening 103 and a zipper head 143 slidably mounted to the first and second zipping elements 141, 142 to engage the first and second zipping elements 141, 142 with each other, wherein the illuminator 22 is mounted on the zipper head 143 to provide the alerting signal for the container body 10.

The illuminator 22 is preferably constructed as a LED mounted on the zipper head 143 having a light holder 1431 to hold the LED of the illuminator 22 on the zipper head 143 wherein a replaceable battery of the power source 21 is received in the light holder 1431 to electrically connect with the illuminator 22. Accordingly, the switching means 23 is a manual switch arranged in such a manner that when the illuminator 22 is rotatably mounted in the light holder 1431 until the illuminator 22 is in contact with the power source 21, the illuminator 22 is electrically connected with the power source 21 to provide the alerting signal. Therefore, the illuminator 22 is manually switched off when the illuminator 22 is unscrewed with respect to the light housing 1431.

Figure 5:
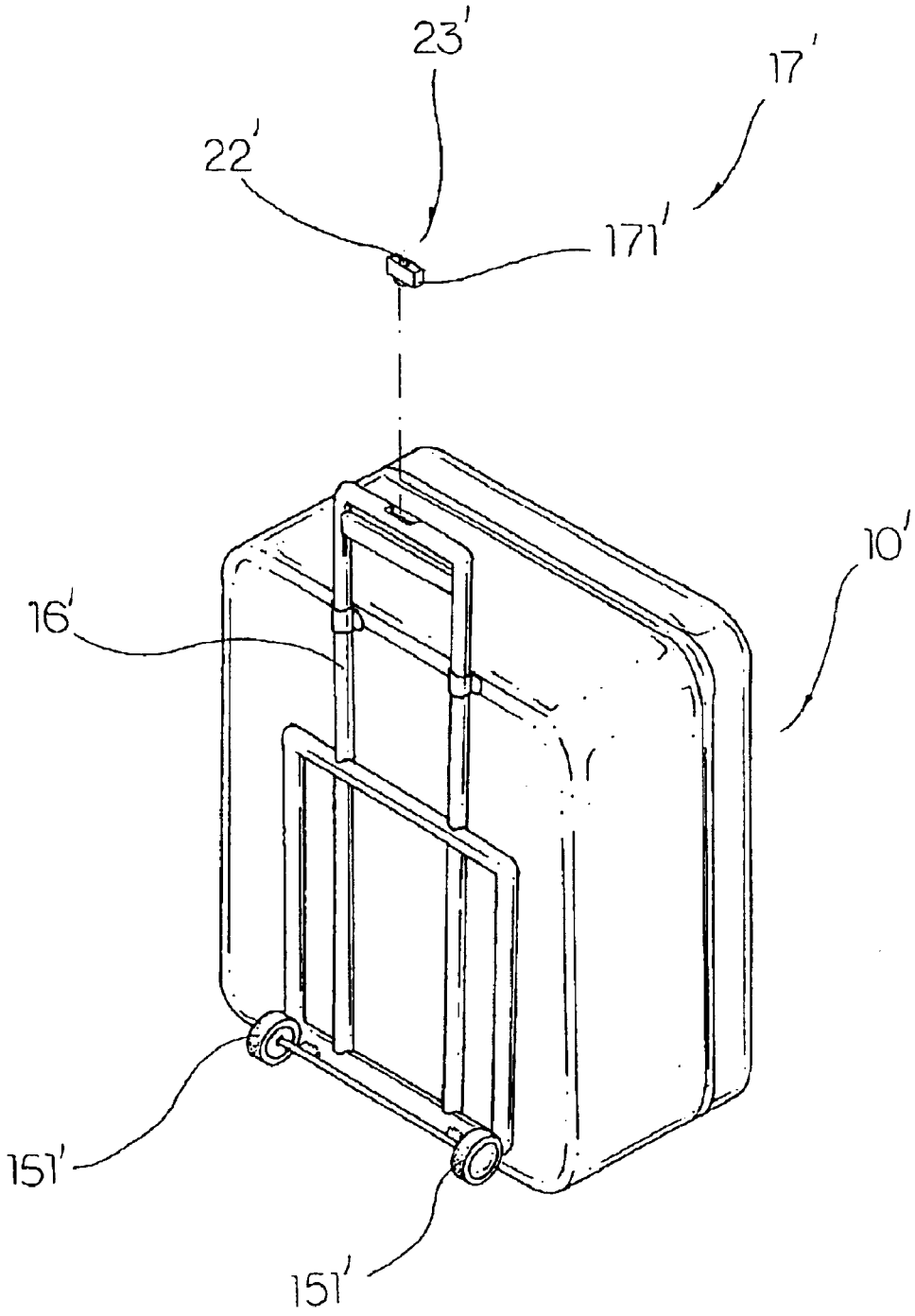
FIG. 5 is a perspective view of a traveling container incorporated with a safety alert system according to a second preferred embodiment of the present invention.

As shown in FIG. 5, a traveling container of a second embodiment illustrates an alternative mode of the first embodiment of the present invention, wherein the container body 10' is constructed as a heavy duty traveling container.

The container body 10' further comprises a wheel assembly 15' which comprises a supporting wheel 151' rotatably mounted on a bottom side of the container body 10', and a retractable handle bar 16' upwardly extended from the wheel assembly 15', wherein the illuminator 22' is provided on the handle bar 16' to provide the alerting signal for the container body 10'.

Accordingly, most conventional container body 10' comprises a locking device 17' provided at the handle bar 16' to lock up the handle bar 16' with the wheel assembly 15' wherein the locking device 17' comprises a releasable button 171' movably mounted on the handle bar 16' to release the locking up of the handle bar 16' with respect to the wheel assembly 15'. Therefore, the illuminator 22' is mounted at the releasable button 171' of the locking device 17'.

In addition, the releasable button 171' can be constructed as a switching means 23' of the safety alert system 20' in such a manner that when the releasable button 171' is pressed, the illuminator 22' is switched on to provide the alerting signal. It is worth to mention that when the rope light 221 of the illuminator 22 is constructed as the piping tube 12, as shown in FIG. 2, the releasable button 171' can be embodied as the manual switch of the switching means 23 to switch on and off the illuminator 22' manually.

Figure 6:
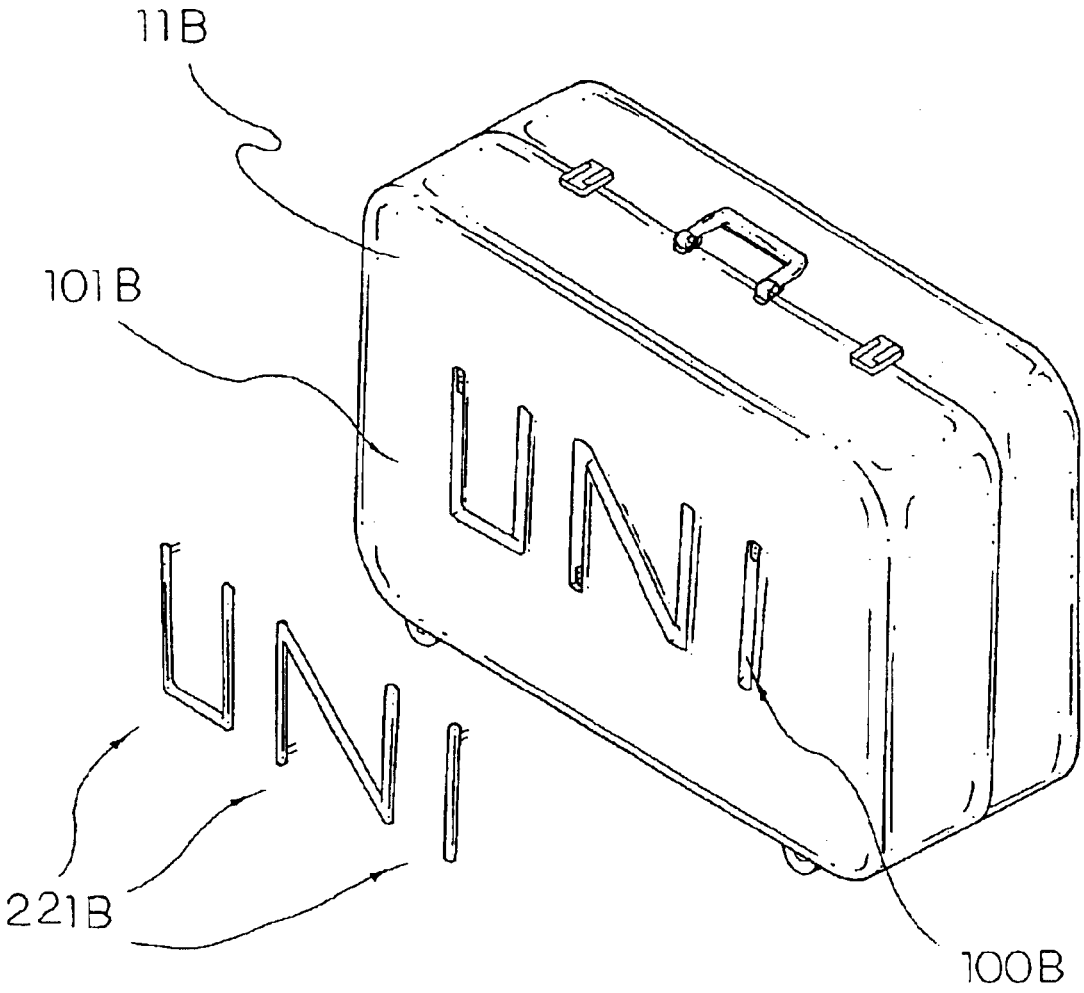
FIG. 6 illustrates the safety alert system installed into a handle bar of the traveling container according to the above second preferred embodiment of the present invention.

FIG. 6 illustrates the illuminator 22B directly mounted on the outer side 101B of the container body 10B, wherein the container body 10B is constructed as a hard casing container. Each of the container panels 11B is made of rigid but light weight material, such as aluminum, to protect the items stored in the container body 10B.

The rope light 221B of the illuminator 22B is embedded on the outer side 101B of the container body 10B wherein the container body 10B has a mounting channel 100B indented on the outer side 101B of at least one of the container panels 11B such that the rope light 221B is securely received in the mounting channel 100B so as to hole the rope light 221B on the outer side 101B of the container body 10B in position.

In view of above, the safety alert system of the present invention is capable of not only providing the alerting signal to aid the user in notifying the traveling container in attendance but also increasing the visibility of the traveling container especially at the low light condition. Since the rope light of the illuminator can provide different light effect while being cost effective, the safety alert system can enhance the aesthetic appearance of the traveling container.

While the foregoing description and drawings describe the preferred embodiments and their alternatives of the present invention, it should be appreciated that certain obvious modifications, variations, and substitutions may be made without departing from the spirit and scope of the present invention. For example, the safety alert system can be incorporated with any component of the container body without altering the original structural design of the traveling container.

What is claimed is:

1. A traveling container, comprising:

a container body having an outer side and a mounting channel indented on said outer side; and a safety alert system comprising a power source supported by said container body and an illuminator provided on said outer side of said container body for providing an alerting signal and enhancing a visibility of said container body, wherein said illuminator comprises an elongated rope light, which has a terminal end electrically connected to said power source, securely received in said mounting channel to hold said rope light in position, so that said rope light is embedded on said outer side of said container body.

2. A traveling container, as recited in claim 1, wherein said container body comprises a retractable handle bar upward extended therefrom, wherein said safety alerting system further comprises a switch button movable mounted on said handle bar to manually switch said illuminator in an on and off manner.

3. A traveling container, comprising:

a container body having an outer side and a mounting channel indented on said outer side; and a safety alert system comprising a power source supported by said container body, an illuminator provided on said outer side of said container body for providing an alerting signal and enhancing a visibility of said container body, and means for switching said illuminator in an on and off manner, wherein said illuminator comprises an elongated rope light, which has a terminal end electrically connected to said power source, securely received in said mounting channel to hold said rope light in position, so that said rope light is embedded on said outer side of said container body.

* * * * *